United States Patent [19]

Fujiwara et al.

[11] Patent Number: 4,560,743

[45] Date of Patent: Dec. 24, 1985

[54] POLY(P-PHENYLENETEREPHTHALAMIDE) FIBERS

[75] Inventors: Takashi Fujiwara; Tamio Ishitobi, both of Nobeoka, Japan

[73] Assignee: Asahi Kasei Kogyo Kabushiki Kaisha, Osaka, Japan

[21] Appl. No.: 646,115

[22] Filed: Aug. 31, 1984

[30] Foreign Application Priority Data

Sep. 2, 1983 [JP] Japan ..... 58-160405

[51] Int. Cl.[4] ..... C08G 20/20

[52] U.S. Cl. ..... 528/348; 521/184

[58] Field of Search ..... 528/348; 521/184

[56] References Cited

U.S. PATENT DOCUMENTS 3,819,587 6/1974 Kwoleck ..... 260/78 R
3,869,430 3/1975 Blades ..... 260/78 S
4,016,236 4/1977 Nagasawa et al. ..... 264/184
4,374,977 2/1983 Fujiwara et al. ..... 528/348
4,374,978 2/1983 Fujiwara et al. ..... 528/348

*Primary Examiner*—Harold D. Anderson
*Attorney, Agent, or Firm*—Finnegan, Henderson, Farabow, Garrett & Dunner

[57] ABSTRACT

Poly(p-phenyleneterephthalamide) fibers having a very high tensile strength is described. The fibers consist essentially of poly(p-phenyleneterephthalamide) having an inherent viscosity of at least 5 dl/g as determined at 25° C. in sulfuric acid having a concentration of 98 wt. % at a polymer concentration of 0.5 g/dl. The fibers are composed of single filaments of 0.5 to 3 denier, wherein the single filament tensile strength is at least 35 g/denier. The macrovoid number, hereinbefore defined, of the fibers is not more than 10 per 100 mm. The asymmetry, hereinbefore defined, of the fibers is not more than 0.2.

2 Claims, 2 Drawing Figures

POLY(P-PHENYLENETEREPHTHALAMIDE) FIBERS

BACKGROUND OF THE INVENTION (1) Field of the Invention

The present invention relates to an improved poly(p-phenyleneterephthalamide) (hereinafter referred to as "PPTA" for brevity) fiber. More particularly, it relates to an improved PPTA fiber having a very high tensile strength.

(2) Description of the Prior Art

It has been expected for many years that a fiber excellent in the tensile characteristics will be prepared from PPTA which is a rigid polymer. In fact, Kwolek (U.S. Pat. No. 3,819,587) and Blades (U.S. Pat. No. 3,869,429 and U.S. Pat. No. 3,869,430) proposed processes for preparing high-tenacity fibers from PPTA.

PPTA fibers disclosed in these prior art references and commercially available PPTA fibers such as Kevlar and Kevlar 49 are characterized by a high tensile strength, but in each of these PPTA fibers, the tensile strength of the single filament is 32 g/denier at highest. With recent progress in the industrial society, a demand for a fiber having a higher tensile strength is increasing. The reason is that a stronger material can be realized with reduced amount (that is, with a lighter weight and at a lower cost).

We made research with a view to satisfying this desire by enhancing the tensile strength in PPTA fibers, and we found that the tensile strength of the fiber, which is a fracture phenomenon value, is not determined by a single structural factor but various defect factors participate in the tensile strength in a complicated manner, and if at least one of these factors is not in the satisfactory state, a high tensile strength cannot be realized. It also was found that since known fibers have some defect factors or other, the monofilament tensile strength is 32 g/denier at highest and in order to realize a high tensile strength that cannot be at-tained in the conventional fibers, it is necessary to control all the defect factors below certain levels. It was further found that in order to obtain a fiber having such a high tensile strength, it is necessary to adopt considerably refined preparation conditions and pro-cedures. We furthered our research based on these findings, and as the result, we have now completed the present invention.

SUMMARY OF THE INVENTION

It is the primary object of the present invention to provide PPTA fibers having a very high tensile strength.

More specifically, in accordance with the present invention, there is provided a poly(p-phenyleneterephthalamide) fibers consisting essentially of poly(p-phenyleneterephthalamide) having an inherent viscosity of at least 5 dl/g as determined at 25° C. in sulfuric acid having a concentration of 98% by weight at a polymer concentration of 0.5 g/dl, said fibers being composed of single filaments of 0.5 to 3 denier, wherein the single filament tensile strength is at least 35 g/denier, the macrovoid number is not more than 10 per 100 mm, and the asymmetry is not more than 0.2.

Incidentally, the macrovoid number is the number of voids having a size of at least about 1 μm, that can be counted when optical 20 single filaments are selected from the fibers and each single filament is observed along a length of 5 mm from an optional point by an optical microscope at 400 magnifications, with proviso that in case of a void elongated in the direction of the fiber axis, the number of portions having an increased width is regarded as the number of macrovoids. The asymmetry is the value obtained by determining a W-shaped interference fringe of the single filament by using a quantitative transmittance type interference microscope using polarized light vibrating in a direction perpen-dicular to the fiber axis, measuring the absolute value of the difference between the angle ABC and the angle ACB in the interference fringe having apexes A, B and C (A being the central apex) with respect to at least 20 points in optional 5 single filaments selected from the fibers and dividing the number of the measuring points where the absolute value of the angle difference is at least 20° by the number of all the measuring points.

BRIEF DESCRIPTION OF THE DRAWINGS

FIG. 1 shows a symmetric interference fringe and FIG. 2 shows an asymmetric interference fringe.

DESCRIPTION OF THE PREFERRED EMBODIMENTS

Figure 1:
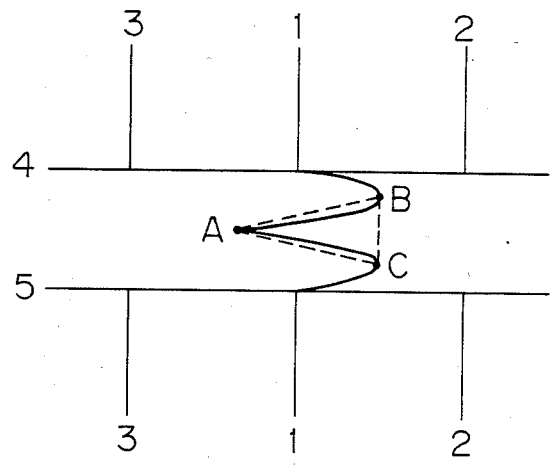
FIGS. 1 and 2 are a diagram given to illustrate the asymmetry used for specifying the fiber of the present invention, in which the solid line diagrammatically indicates the interference fringe observed by a quantitative transmittance type interference microscope using polarized light vibrating in a direction perpendicular to the fiber axis and the broken line diagrammatically shows the method for drawing a triangle having apexes A, B and C from the interference fringe.

It is preferred that the central birefringence of the fiber be at least 0.51. The central birefringence can be determined in the following manner. In the specification of U.S. Pat. No. 4,374,977, the refractive index (Np) to polarized light vibrating in a direction parallel to the fiber axis and the refractive index (Nv) to polarized light vibrating in a direction perpendicular to the fiber axis are defined, and methods for measuring these refractive indexes are explained. The central birefringence adopted in the present invention is obtained by adopting the values Np and Nv at the center of the fiber and calculating the difference (Np−Nv). The central birefringence of the fiber is regarded as a parameter reflecting the packing degree of the molecular chain of the polymer (the degree of reduction of spaces or microvoids) and the degree of orientation of the molecular chain. Accordingly, the central birefringence smaller than 0.51 means that the packing degree of the molecular chain is too low and/or the orientation of the molecular chain is insufficient. This is a significant defect inhibiting attainment of a high strength. In other words, the central birefringence of at least 0.51 is one of requirements to be satisfied for attaining a single filament tensile strength of at least about 35 g/denier. It is preferred that the central birefringence of the fiber be at least 0.515, especially at least 0.52. It is desired that the central birefringence of the fiber be as high as possible. The upper limit of the central birefringence is not critical. However, according to Manabe et al. Journal of Textile Machine Association, 33, page 54 (1980) , it is considered that the theoretical upperlimit value of the central birefringence is about 0.60 to about 0.65. Although the central birefringence of the fiber is influenced by various spinning conditions, in order to increase the central birefringence of the fiber, the following are especially important: (i) the polymer concentration in a spinning dope should be high, and the extremely good solvent for PPTA should be used, (ii) a so-called air-gap wet spinning method should be adopted, and the extrudate should be coagulated as slowly as possible after shear deformation and elongation deformation exceeding certain levels have been given to the dope, and (iii) no unnecessary tension should be imposed onto the fiber at the coagulating, water-washing and drying steps. Kevlar and Kevlar 49, which are commercially available PPTA fibers, have a birefringence of 0.505 at highest. Although Yang et al. propose a different method for measuring a birefringence of a PPTA fiber Journal of Polymer Science, Polymer Physics Ed., 20, page 981 (1982), the method of Yang et al. is not adopted in the present invention.

It is indispensable that PPTA constituting the fiber of the present invention should have an inherent viscosity of at least 5 dl/g as measured at 25° C. in sulfuric acid having a concentration of 98% by weight at a polymer concentration of 0.5 g/dl. A high degree of polymerization of PPTA is one of necessary conditions for attaining a high tensile strength. It is preferred that PPTA constituting the fiber of the present invention should have an inherent viscosity of at least 6 dl/g.

The fiber of the present invention consists essentially of PPTA. By the term "essentially" used herein, it is meant that a small amount of a polymer other than PPTA, such as poly(m-phenyleneterephthalamide), poly(p-phenyleneisophthalamide), poly(m-phenyleneisophthalamide, poly(polymethyleneterephthalamide), an aliphatic polyamide, an alicyclic polyamide, a polyester, a polyimide, a polyurethane or polyurea may be blended in PPTA, PPTA may be copolymerized with minor amounts of other recurring units such as nucleus-substituted p-phenylene units, nucleus-substituted or unsubstituted biphenylene units, o-phenylene units, m-phenylene units, (poly)methylene units, pyridylene units, units of ester, urethane, urea, ether or thioether bonds, or additives such as a dye, an antioxidant, an ultraviolet absorber, a gloss agent and a pigment may be incorporated into PPTA, so far as the structural requirements of the present invention are satisfied and the intended functional effects of the present invention are attained.

The single filament fineness (average value) of the fiber of the present invention should be in the range of from 0.5 to 3 denier. For production of a fiber having a single filament fineness smaller than 0.5 denier, various contrivances should be made for attenuation. For example, it is necessary to increase the spinning draft, increase the spinning speed and reduce the polymer concentration in the spinning dope, with the result that it becomes difficult to attain a high tensile strength. In case of a fiber having a single filament fineness exceeding 3 denier, disturbance or deviation of the orientation or packing degree of the molecular chain in the section of the fiber is increased and shear deformation or elongation deformation of the dope becomes insufficient, and the so-called tie molecular chain is reduced and attainment of a high tensile strength becomes difficult.

It is indispensable that in the fiber of the present invention, the macrovoid number should be not more than 10 per 100 mm of the length of the fiber. The macrovoid number referred to herein is the number of voids such as bubbles that can be counted when optional 20 single filaments (monofilaments) are selected from the fiber (yarn) and each single filament is observed along a length of 5 mm from an optional point by an optical microscope at 400 magnifications. In order to facilitate the counting, it is preferred that the observation be carried out by using an immersing liquid such as olive oil. Since the counting is carried out by using the optical microscope at 400 magnifications, voids having a size of at least about 1 μm are objects to be counted, and therefore, the term "macrovoid" is herein used. It is considered that the majority of macrovoids to be observed are based on bubbles contained in the dope and/or bubbles produced during spinning. Since these macrovoids act as parts where the stress is concentrated when the tensile stress is applied to the fiber, the presence of these macrovoids is a cause of reduction of the tensile strength. A void elongated in the direction of the axis of the fiber is sometimes observed as a special instance of the macrovoid. In case of this void, the number of portions where the width (thickness) is increased is regarded as the macrovoid number. The macrovoid number of 0 is ideal, but from the practical viewpoint in the industrial manufacture, it is preferred that the macrovoid number be not more than 10 per 100 mm. In a fiber having a macrovoid number larger than 10 per 100 mm, the tensile strength is extremely low. In order to attain a macrovoid number less than 10 per 100 mm, it is necessary to perform deaeration of the dope very carefully.

Figure 2:
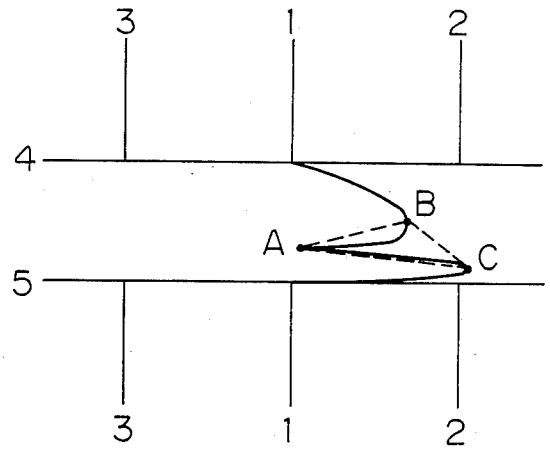

It is indispensable that the asymmetry of the fiber of the present invention should be not more than 0.2. The asymmetry referred to herein is determined in the following manner. When the single filament is observed by a quantitative transmittance type interference microscope using polarized light vibrating in a direction perpendicular to the fiber axis according to the description of U.S. Pat. No. 4,374,977, an interference fringe as shown in FIGS. 1 and 2 is obtained. In FIGS. 1 and 2, reference numerals 1, 2 and 3 designate backgrounds of interference fringe, reference numerals 4 and 5 designate outer edges of fiber, A is central apex, and B and C are apexes. A triangle ABC is determined by connecting three apexes A, B and C to one another. The apex A is the central apex. The angles ABC and ACB are measured and the absolute value of the difference between the two angles is determined. According to this method, the angle difference is determined in at least 20 optional points with respect to at least 5 single filaments. Finally, the number of the measuring points where the angle difference (absolute value) is at least 20° is divided by the number of all the measuring points. The obtained value is designated as the asymmetry.

It can be understood that the asymmetry thus defined is a parameter reflecting the disturbance of distribution of the orientation of the molecular chain or the lateral orientation in the section of the fiber, the disturbance of distribution of the packing degree of the molecule chain and the disturbance of the sectional shape of the fiber. Accordingly, it can be understood that the fiber of the present invention has a substantially circular section. It has been found that if the asymmetry exceeds 0.2, there are present various disturbances as described above and there is included an unnecessary strain in the fiber because of these disturbances, and hence, the strength of the fiber is reduced. It is preferred that the asymmetry be not more than 0.1. As the preparation factors causing increase of the asymmetry in a PPTA fiber, there can be mentioned too low a temperature of the dope, a temperature unevenness in the dope, too high a speed of elongation deformation by drafting after extrusion of the dope, too high a coagulation speed, too high a tension imposed on the coagulated extrudate and an unnecessary tension imposed at the water-washing or drying step. Accordingly, if spinning is carried out without paying any attention to these factors, the obtained fiber has a large asymmetry and the strength is not increased.

Even if PPTA fibers disclosed in the prior art satisfy, for example, the requirement of the central birefringence, when they fail to satisfy the requirement of the macrovoid number or asymmetry, manifestation of a high tensile strength is inhibited, and it is sufficiently presumed that a similar phenomenon practically takes place. It is considered that the reason why the tensile strength of PPTA fibers disclosed in the prior art reference is 32 g/denier at highest is that they fail to simultaneously satisfy all the requirements specified in the present invention.

The deviation of the fineness in fibers is one of causes of inhibition of manifestation of a high tensile strength. However, although the deviation of the fineness has a close relation to the above-mentioned asymmetry, it has been confirmed that the asymmetry has a closer relation to the tensile strength than the deviation of the fineness.

It is preferred that the density of the fibers of the present invention be at least 1.44 g/cm$^3$ as determined according to the so-called density gradient tube method. Unnecessary cracks are not preferred for the fiber of the present invention. In case of PPTA fibers, in general, almost no cracks are formed unless they are intentionally formed.

As pointed out hereinbefore, the fiber of the present invention is characterized in that all the defect factors are eliminated, and therefore, a very high tensile strength can be realized. More specifically, the single filament tensile strength of the fiber of the present invention is 35 g/denier or higher. Furthermore, by dint of the above characteristics, the fibers of the present invention are hardly fibrilated (almost no fluffs are formed). When the fiber of the present invention is formed into a cord, a high twist strength utilization ratio can be attained.

It has been found that the fibers of the present invention can be prepared only when special conditions are added to the known process for the preparation of PPTA fibers. An example of the process for the preparation of the fibers of the present invention will now be described, though the preparation process is not limited to the process described below.

In the preparation of the fibers of the present invention, it is first of all necessary to prepare a dope of PPTA by dissolving PPTA in sulfuric acid or a solvent composed mainly of sulfuric acid at a polymer concentration of about 18 to about 20% by weight. As pointed out hereinbefore, PPTA may be copolymerized with a small amount of other component or blended with a small amount of other polymer, if necessary. In general, slight reduction of the polymerization degree of PPTA is caused in the state of a dope. In view of this fact, it is preferred that the inherent viscosity of charged PPTA be at least about 5.5 dl/g. PPTA can be prepared, for example, according to the process disclosed in Japanese Patent Publication No. 35-14399.

The solvent used for formation of the dope is sulfuric acid or a mixture composed mainly of sulfuric acid. Sulfuric acid having a concentration of about 99.9 to about 100.1% by weight should be used. If this requirement is not satisfied, it is difficult to obtain a fiber capable of simultaneously satisfying the requirements of the central birefringence and the inherent viscosity. As the solvent to be mixed with sulfuric acid, there can be mentioned solvents having a PPTA-dissolving power comparable to or higher than that of sulfuric acid, such as chlorosulfuric acid, fluorosulfuric acid and dichloroacetic acid. The polymer concentration is preferably 19 to 20% by weight.

When the polymer concentration is in the above-mentioned range, it is necessary to slightly heat the dope. If the temperature is high, the speed of deterioration of the polymer is increased. Accordingly, it is not preferred that the dope should be exposed to a high temperature for a long time. If the temperature is too low or the temperature is uneven, a dope having a semi-gloss, which is very similar to a solid, is formed. Accordingly, too low a temperature or an uneven temperature should be avoided. The temperature control of the dope being extruded from the spinneret is especially important. The dope used in the present invention has an optical anisotropy. An ordinary additive such as an antioxidant or an ultraviolet absorber may be incorporated in the dope.

Deaeration, filtration and metering of the so-prepared dope should be carefully performed before extrusion through the spinneret. The dope is once extruded into air from the spinneret and guided into a coagulating bath. The number of orifices in the spinneret is not particularly critical, but in view of the speed of shearing imposed on the dope in the orifices and the speed of elongation deformation imparted to the dope after the spinneret, the diameter of the orifices is adjusted to 0.03 to 0.15 mm. It is preferred that the orifices be arranged so that the ratio between the distance of from the orifice closest to the center of the spinneret surface to the center of the spinneret and the distance of from the orifice most apart from the center of the spinneret surface to the center of the spinneret is not so large.

It is important that the dope stream extruded from the spinneret should first be travelled through air. If the dope is extruded directly into the coagulating bath without passage through air, it is difficult to increase the draft ratio over 1.5 and it is impossible to impart sufficient elongation deformation to the dope, with the result that the obtained fiber has a low density and both the tensile strength and the elongation are low. The thickness of the air layer through which the extrudate is travelled (that is, the distance between the spinneret surface and the coagulating bath surface) is appropriately selected within the range of from 5 to 15 mm, while taking the spinning speed and draft ratio into consideration.

The dope stream is then guided into the coagulating bath and coagulated in the bath. In the preparation of the fiber of the present invention, it is preferred that the temperature of the coagulating bath be not higher than about 5° C., especially not higher than 0° C. As the coagulating solution used in the present invention, there can be mentioned water, aqueous solutions of inorganic substances such as an aqueous sulfuric acid solution, an aqueous caustic soda solution and an aqueous sodium sulfate solution, and organic solutions such as methanol, ethylene glycol, acetone and aqueous solutions thereof.

It has been found that reduction of the speed of coagulation of PPTA by maintaining the temperature of the coagulating bath at a level much lower than 0° C., for example, −15 to −30° C., is effective for decreasing the macrovoid number and controlling the asymmetry to a low level. However, since the viscosity and density of the coagulating solution are ordinarily increased by this reduction of the temperature, there is produced an adverse effect of increasing the tension on the yarn being coagulated. Therefore, it is necessary to made a certain contrivance for reducing this adverse effect.

It is preferred that a funnel-shaped coagulating bath as shown in FIG. 3 of U.S. Pat. No. 4,374,977, because the tension imposed on the fiber being coagulated is low and the bath is excellent in the symmetry for advancing the coagulation uniformly. It is preferred that the tension imposed on the fiber being coagulated at the coagulating step be not larger than 0.5 g per denier of the water-washed and dried fiber. Furthermore, it is preferred that the acid (solvent) be removed so that the amount of sulfuric acid left in the filamentary extrudate taken out from the coagulating bath is not larger than 0.3 g per g of the polymer (that is, not larger than 30% by weight). The depth of the coagulating bath and other coagulating bath conditions should be decided relatively to the spinning speed and denier so that the above requirements are satisfied.

The coagulated fiber is taken out from the coagulating bath at such a speed that the draft ratio is 5 to 8. The draft ratio referred to herein means the value obtained by dividing the linear speed of the coagulated fiber taken out from the coagulating bath by the linear speed of the dope passing through the spinneret. If the draft ratio is lower than 5, orientation of the molecular chain is insufficient and it often happens that the central birefringence of the fiber is smaller than 0.51. If the draft ratio exceeds 8, the asymmetry of the fiber is abruptly increased probably because of unreasonable elongation deformation.

The coagulated fiber taken out from the coagulating bath should be subjected to water washing. Water washing may be carried out in one stage or two or more stages. In order to enhance the efficiency of water washing, washing with an aqueous solution of an alkaline substance such as caustic soda may be carried out in combination with water washing. It is preferred that the solvent be removed by extraction as much as possible by water washing. For example, in the case where sulfuric acid is used as the solvent, it is preferred that the amount of the residual solvent be controlled below about 1% by weight. Furthermore, it is preferred that water washing be carried out under a tension as low as possible, for example, a tension of not larger than about 1 g per denier of the water-washed and dried fiber. For this purpose, a method in which the coagulated fiber is deposited on a net and water is sprinkled on the deposited fiber is preferably adopted. In view of the dimension stability and fatigue resistance of the fiber, it is especially preferred that water washing, steam treatment and drying be carried out on a net under specific conditions disclosed in U.S. Pat. No. 4,419,317.

An oiling agent or the like is applied to the water-washed fiber according to need, and the fiber is dried to obtain a product yarn. It is preferred that drying be carried out under no unnecessary tension at a temperature higher than room temperature, especially a temperature of at least 100° C., for example, according to the method disclosed in U.S. Pat. No. 4,419,317 for such a time that the water content of the fiber is several % or lower.

When it is desired to modify properties other than the tensile strength, for example, the elongation and modulus, there may be adopted a method where drying is carried out under a tension, for example, a method in which the fiber is dried in the state wound on a bobbin or hank or a method in which the fiber is travelled on a hot roll. In a special case, a heat treatment may be carried out under a high tension. However, since these methods increase the asymmetry of the fiber or reduce the inherent viscosity to reduce the tensile strength, it is recommended that adoption of these methods should be avoided.

The fibers of the present invention have not only characteristics of conventional PPTA fibers, such as high modulus, high heat resistance and high chemical resistance, but also especially high tensile strength, improved fibril resistance and high elongation. Accordingly, the fibers of the present invention can be used effectively as a rubber reinforcer for tire cords and belts and also as a plastic reinforcer by utilizing these excellent properties. When the fibers of the present invention are used as a rubber or plastic reinforcer, they are ordinarily used in the form of a multifilament yarn, where the characteristics of the fibers of the present invention are most effectively exerted. However, the use of the fibers of the present invention is not limited to this aspect, but the fibers of the present invention can be used in the form of a roving yarn, cord, staple fiber or chopped strand as ropes, woven fabrics, reinforcers for plastics, metals, cements and ceramics, and as wadding.

The present invention will now be described in detail with reference to the following examples that by no means limit the scope of the invention.

EXAMPLE 1 AND COMPARATIVE EXAMPLE 1

PPTA having an inherent viscosity of 6.5 dl/g was prepared according to the process disclosed in the Reference Example of U.S. Pat. No. 4,419,317.

PPTA was dissolved in sulfuric acid having a concentration of 99.9% by weight at 75° C. so that the polymer concentration was 19% by weight. Deaeration was carried out under reduced pressure for about 2 hours or about 4 hours. The thus-obtained dope maintained at 75° to 80° C. was filtered, extruded from a spinneret having 200 circular fine orifices having a diameter of 0.065 mm, travelled through air and guided into a 20% by weight aqueous solution of sulfuric acid maintained at −10°. The spinneret used had the following orifice arrangement.

The spinneret had a diameter of 45 mm, and 59 orifices were arranged on a circle having a diameter of 41.0 mm from the center of the spinneret surface, 53 orifices were arranged on a circle having a diameter of 36.8 mm from the center, 47 orifices were arranged on a circle having a diameter of 32.6 mm from the center and 41 orifices were arranged on a circle having a diameter of 28.4 mm from the center. Thus, 200 orifices as a whole were arranged on the spinneret surface. The ratio of the distance of the fine orifices closest to the center of the spinneret surface from the center of the spinneret surface to the distance of the fine orifices most apart from the center of the spinneret surface to the center of the spinneret surface was 0.69.

The coagulating, water washing and drying operations were carried out by adopting the apparatus and conditions disclosed in Example 1 of U.S. Pat. No. 4,419,317 (steam treatment step was added between the water washing step and the drying step) to obtain PPTA fibers.

Variable conditions and properties of the obtained fibers are shown in Table 1. The tensile strength, elongation and modulus were measured on 10 single filaments (monofilaments) selected from the multifilament yarn consisting of 200 single filaments according to the methods disclosed in U.S. Pat. No. 3,869,429, and average values were calculated. Namely, the tensile test was carried out at a rate of elongation of 10%/min at an initial gauge length of 2.54 cm by using a Tensilon tester supplied by Toyo Baldwin. In the subsequent examples, the measurement and calculation of average values were conducted in the same manner as described above.

From the results shown in Table 1, it will readily be understood that the fibers of the present invention (fibers obtained in runs 1-1 through 1-4) having a higher tensile strength than the fibers outside the scope of the present invention (fibers obtained in comparative runs 1-1 through 1-6) (at least one of the requirements of the present invention is not satisfied) can be prepared only under specific limited conditions according to specific procedures.

TABLE 1

| | Spinning Conditions | | | | | | |
|---|---|---|---|---|---|---|---|
| Example No. | Deaeration time (Hrs) | Temperature (°C.) of Dope upon Passing through Spinneret | Thickness (mm) of Air Layer | Draft Ratio | Depth (cm) of Coagulating Bath | Spinning Speed (m/min) | Tension* (g/denier) on Coagulated Fiber |
| Comp. Ex. 1-1 | 2 | 78 | 5 | 6.0 | 10 | 250 | 0.24 |
| Comp. Ex. 1-2 | 2 | 83 | 3 | 6.0 | 10 | 250 | 0.31 |
| Ex. 1-1 | 2 | 83 | 10 | 7.2 | 10 | 250 | 0.17 |
| Ex. 1-2 | 4 | 82 | 8 | 5.5 | 15 | 150 | 0.12 |
| Ex. 1-3 | 4 | 90 | 15 | 8.0 | 5 | 200 | 0.25 |
| Ex. 1-4 | 4 | 85 | 10 | 7.6 | 10 | 300 | 0.43 |
| Comp. Ex. 1-3 | 4 | 75 | 10 | 6.0 | 5 | 150 | 0.20 |
| Comp. Ex. 1-4 | 4 | 81 | 25 | 7.2 | 10 | 200 | 0.16 |
| Comp. Ex. 1-5 | 4 | 80 | 10 | 9.8 | 5 | 300 | 0.39 |
| Comp. Ex. 1-6 | 4 | 83 | 15 | 3.0 | 5 | 150 | 0.11 |

| | Properties of Fiber | | | | | | | |
|---|---|---|---|---|---|---|---|---|
| Example No. | Central Birefringence of Fiber | Inherent Viscosity (dl/g) | Macrovoid Number (per 100 mm) | Asymmetry | Single Filament Denier | Tensile Strength (g/denier) | Elongation (%) | Modulus (g/denier) |
| Comp. Ex. 1-1 | 0.507 | 6.3 | 23 | 0.55 | 1.6 | 29.1 | 4.8 | 460 |
| Comp. Ex. 1-2 | 0.525 | 6.2 | 17 | 0.70 | 1.6 | 27.7 | 4.9 | 430 |
| Ex. 1-1 | 0.518 | 6.2 | 8 | 0.12 | 1.4 | 35.8 | 5.3 | 510 |
| Ex. 1-2 | 0.530 | 6.0 | 1 | 0.15 | 1.8 | 37.3 | 5.6 | 480 |
| Ex. 1-3 | 0.511 | 5.9 | 3 | 0.00 | 1.2 | 36.6 | 5.8 | 440 |
| Ex. 1-4 | 0.536 | 6.1 | 0 | 0.04 | 1.2 | 40.2 | 6.1 | 470 |
| Comp. Ex. 1-3 | 0.523 | 5.8 | 6 | 0.35 | 1.6 | 30.8 | 5.1 | 420 |
| Comp. Ex. 1-4 | 0.493 | 5.8 | 2 | 0.00 | 1.4 | 28.2 | 5.4 | 400 |
| Comp. Ex. 1-5 | 0.512 | 5.9 | 5 | 0.25 | 1.0 | 31.1 | 4.1 | 540 |
| Comp. Ex. | 0.476 | 5.8 | 1 | 0.05 | 3.3 | 24.3 | 6.2 | 360 |

TABLE 1-continued

| 1-6 |
|---|

Note:
*Value obtained by dividing the measured value of the tension of the yarn taken out from the coagulating bath and being travelled by the denier of the water-washed and dried yarn

EXAMPLE 2

A part of the coagulated yarn of Example 1-4 was wound on a stainless steel bobbin just after it had come out from the coagulating bath, and the yarn was water-washed and dried (at 120° C. for a whole day and night) in the state wound on the bobbin.

The thus-obtained fiber was characterized by a central birefringence of 0.521, an inherent viscosity of 6.1 dl/g, a macrovoid number of 2 per 100 mm, an asymmetry of 0.08 and a single filament denier of 1.1. The tensile strength of the fiber was 37.0 g/denier, i.e., slightly lower than the tensile strength of the fiber obtained in run 1-4 of Example 1, but the modulus of the fiber was 550 g/denier, i.e., slightly higher than that of the fiber obtained in run 1-4 of Example 1.

EXAMPLE 3

The fiber obtained in Example 1-4 was subjected to a heat treatment in a nitrogen atmosphere maintained at 300° C. under a tension of 5.5 g/denier for 10 seconds.

The heat-treated fiber was characterized by a central refractive index of 0.518, an inherent viscosity of 6.0 dl/g, a macrovoid number of 7 per 100 mm, an asymmetry of 0.10, a single filament denier of 1.1, a tensile strength of 35.7 g/denier, an elongation of 3.2% and a modulus of 880 g/denier.

EXAMPLE 4

PPTA having an inherent viscosity of 7.2 dl/g was dissolved in sulfuric acid having a concentration of 100.1% by weight at 80 to 85° C. so that the polymer concentration was 20% by weight. Deaeration was carriedS out under a reduced pressure of 0.5 to 0.2 mmHg for about 5 hours. In the same spinning apparatus including the spinneret as used in Example 1, the spinning operation was carried out in the same manner as described in Example 1 except that the temperature of the dope at the time of passage through the spinneret was adjusted to 85±2° C., the thickness of the air layer was 10 mm, the draft ratio was 5.2 and the spinning speed was 250 m/min.

In the first run, an aqueous 10% by weight sulfuric acid solution maintained at −2° C. was used as the coagulating solution and the depth of the coagulating bath was adjusted to 12 cm. The thus-obtained fiber was characterized by a central birefringence of 0.514, an inherent viscosity of 6.5 dl/g, a macrovoid number of 3 per 100 mm, an asymmetry of 0.10, a single filament denier of 2.0, a tensile strength of 37.5 g/denier, an elongation of 5.2% and a modulus of 470 g/denier.

In the second run, the spinning operation was conducted by using an aqueous 30% by weight sulfuric acid solution maintained at −25° C. as the coagulating solution and adjusting the depth of the coagulating bath to 3 cm. The thus-obtained fiber was characterized by a central birefringence of 0.525, an inherent viscosity of 6.3 dl/g, a macrovoid number of 1 per 100 mm, an asymmetry of 0.05, a single filment denier of 2.1, a tensile strength of 36.0 g/denier, an elongation of 6.3% and a modulus of 580 g/denier.

What is claimed is:

1. A poly(p-phenyleneterephthalamide fiber consisting essentially of poly(p-phenyleneterephthalamide) having an inherent viscosity of at least 5 dl/g as determined at 25° C. in sulfuric acid having a concentration of 98% by weight at a polymer concentration of 0.5 g/dl, said fiber being composed of single filaments of 0.5 to 3 denier, wherein the single filament tensile strength is at least 35 g/denier, the macrovoid number, defined below, is not more than 10 per 100 mm, and the asymmetry, defined below, is not more than 0.2, the macrovoid number being the number of voids having a size of at least about 1 μm, that can be counted when optional 20 single filaments of said fiber are selected and each single filament is observed along a length of 5 mm from an optional point by an optical microscope at 400 magnifications, with the proviso that in case of a void elongated in the direction of the fiber axis, the number of portions having an increased width is regarded as the number of macrovoids, and the asymmetry being the value obtained by determining a W-shaped interference fringe of the single filament by using a quantitative transmittance type interference microscope using polarized light vibrating in a direction perpendicular to the fiber axis, measuring the absolute value of the difference between the angle ABC and the angle ACB in the interference fringe having apexes A, B and C, A being the central apex, with respect to at least 20 points in optional 5 single filaments selected from the fiber and dividing the number of the measuring points where the absolute value of the angle difference is at least 20° by the number of all the measuring points.

2. A fiber as set forth in claim 1, wherein the central birefringence of the fiber is at least 0.51.

* * * * *